United States Patent [19]

Kobayashi et al.

[11] Patent Number: 4,462,374

[45] Date of Patent: Jul. 31, 1984

[54] AIR-FUEL RATIO CONTROL METHOD AND APPARATUS UTILIZING AN EXHAUST GAS CONCENTRATION SENSOR

[75] Inventors: Nobuyuki Kobayashi, Toyota; Hiroshi Itoh, Nagoya, both of Japan

[73] Assignee: Toyota Jidosha Kabushiki Kaisha, Toyota, Japan

[21] Appl. No.: 407,560

[22] Filed: Aug. 12, 1982

[30] Foreign Application Priority Data

Aug. 13, 1981 [JP] Japan ..... 56-125989

[51] Int. Cl.[3] ..... F02M 51/00

[52] U.S. Cl. ..... 123/489; 123/440; 123/480

[58] Field of Search ..... 123/489, 479, 480, 440

[56] References Cited

U.S. PATENT DOCUMENTS

| | | | |
|---|---|---|---|
| 4,120,269 | 10/1978 | Fujishiro | 123/489 |
| 4,170,969 | 10/1979 | Asano | 123/489 |
| 4,171,690 | 10/1979 | Hosaka et al. | 123/440 |
| 4,208,993 | 6/1980 | Peter | 123/489 |
| 4,221,193 | 9/1980 | Ezoe et al. | 123/489 |
| 4,364,227 | 12/1982 | Yoshida et al. | 123/489 |
| 4,373,187 | 2/1983 | Ishii et al. | 123/440 |
| 4,385,596 | 5/1983 | Hosaka | 123/489 |
| 4,393,842 | 7/1983 | Otsuka et al. | 123/489 |

*Primary Examiner*—Parshotam S. Lall

*Attorney, Agent, or Firm*—Cushman, Darby & Cushman

[57] ABSTRACT

The reference signal voltage in the lean monitor of the A/F closed-loop control system is selectively changed in accordance with the rotational speed of the engine. The reference signal voltage is small when the rotational speed is high and large when the rotational speed is low.

8 Claims, 8 Drawing Figures

30
MPU
62
RAM
68
ROM
70
I/O
66
FUEL-INJECTION VALVE
26
72
60
ADC
64
I/O
63
COMPARATOR
COMPARATOR
65
40
38
48
50
18
AIR-FLOW SENSOR
36
O2 SENSOR
44
CRANK-ANGLE SENSOR
CRANK-ANGLE SENSOR
46

AIR-FUEL RATIO CONTROL METHOD AND APPARATUS UTILIZING AN EXHAUST GAS CONCENTRATION SENSOR

BACKGROUND OF THE INVENTION

The present invention relates to an air-fuel ratio (A/F) closed-loop control method and apparatus for an internal combustion engine.

It is a well-known practice to provide an internal combustion engine with an A/F closed-control system. Such system calculates the A/F correction factor in response to a detection signal from a concentration sensor. The sensor detects the concentration of a particular component contained in the exhaust gas. An example of such a sensor is an oxygen ($O_2$) sensor for detecting the concentration of oxygen in the exhaust gas. The A/F closed-loop control system corrects the feeding rate of fuel supplied to the engine according to the calculated correction factor so that the engine A/F is the desired value.

Such A/F closed-loop control system is provided in general with a lean monitor. The lean monitor monitors whether or not the $O_2$ sensor's output is continuously maintained at a voltage which indicates that the engine A/F is on the lean side with respect to the stoichiometric condition for a time longer than a predetermined period. Namely, the lean monitor compares the $O_2$ sensor's output with a reference signal and produces a malfunction signal if the $O_2$ sensor's output is continuously below the reference signal for a time longer than a predetermined period. As is known, the $O_2$ sensor's output is continuously held at a small voltage for a long period if the $O_2$ sensor is in an inactive state or if breaks occur in the connector or the wiring of the $O_2$ sensor or in the $O_2$ sensor itself. Therefore, by means of the lean monitor, the inactive state of the $O_2$ sensor and the occurrence of breaks in the $O_2$ sensor can be detected.

In the conventional lean monitor, however, as the reference signal voltage for comparison is fixed at a predetermined voltage, breaks in the $O_2$ sensor or in the connector or the wiring of the $O_2$ sensor sometimes cannot be detected. This is because the $O_2$ sensor's output changes depending upon the engine rotational speed so that the higher the rotational speed, the smaller the $O_2$ sensor's output and vice versa. If the reference signal voltage for comparison is determined at a voltage which is appropriate for detecting breaks and whether or not the $O_2$ sensor is in an inactive state when the rotational speed of the engine is low, the $O_2$ sensor's output is always below the reference signal voltage when the rotational speed is high. Accordingly, if breaks occur at high rotational speed they cannot be detected.

SUMMARY OF THE INVENTION

It is, therefore, an object of the present invention to provide an A/F control method and apparatus having a lean monitor which can definitely detect breaks in the $O_2$ sensor or in the wiring of the $O_2$ sensor and whether or not the $O_2$ sensor is in an inactive condition, irrespective of the operating condition of the engine.

According to the present invention, the reference signal voltage in the lean monitor is selectively changed in accordance with the rotational speed of the engine so that the higher the rotational speed, the smaller the reference signal voltage and vice versa.

The above and other related objects and features of the present invention will be apparent from the description of the present invention set forth below, with reference to the accompanying drawings, as well as from the appended claims.

DETAILED DESCRIPTION OF THE PREFERRED EMBODIMENT

Figure 1:
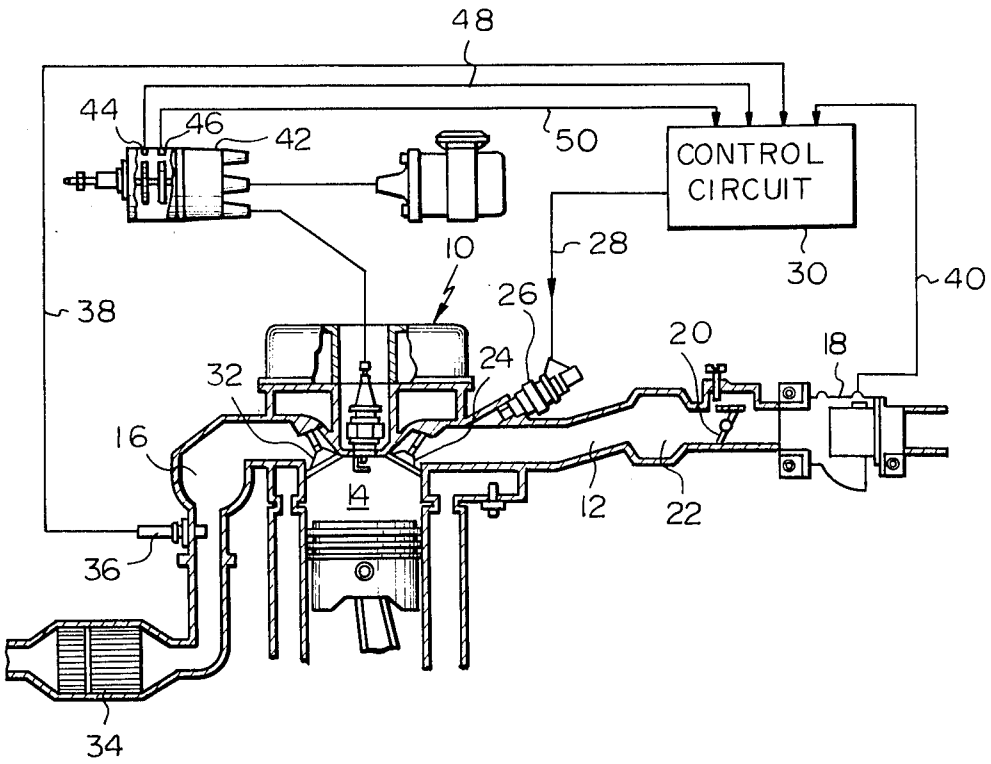
FIG. 1 is a schematic diagram illustrating an A/F control system of an internal combustion engine in which the present invention is used.

In FIG. 1, reference numeral 10 denotes an engine body, 12 an intake passage, 14 a combustion chamber, and 16 an exhaust passage. The flow rate of intake air introduced through an air cleaner, which is not shown, is measured by an air-flow sensor 18. The intake-air flow rate is controlled by a throttle valve 20 interlocked with an accelerator pedal which is not shown. The intake air passing through the throttle valve 20 is introduced into the combustion chamber 14 via a surge tank 22 and an intake valve 24.

Each of fuel-injection valves 26 for the respective cylinders is opened and closed in response to electrical drive pulses that are fed from a control circuit 30 via a line 28. The fuel-injection valves 26 intermittently inject into the intake passage 12 in the vicinity of the intake valve 24 compressed fuel that is supplied from a fuel supply system which is not shown.

The exhaust gas which is produced due to combustion in the combustion chamber 14 is emitted via an exhaust valve 32, the exhaust passage 16, and a catalytic converter 34.

An oxygen sensor 36 mounted on the exhaust passage 16 detects the concentration of the oxygen component in the exhaust gas and produces a detection signal depending upon the detected concentration. The detection signal from the $O_2$ sensor 36 is fed to the control circuit 30 via a line 38.

An air-flow sensor 18 is mounted in the intake passage 12 at a position upstream of the throttle valve 20 to detect the intake-air flow rate. The detection signal from the air-flow sensor 18 is fed to the control circuit 30 via a line 40.

Crank-angle sensors 44 and 46 disposed in a distributor 42 produce pulse signals at every crank angle of 30° and 720°, respectively. The pulse signals produced at every crank angle of 30° are fed to the control circuit 30 via a line 48, and the pulse signals produced at every crank angle of 720° are fed to the control circuit 30 via a line 50.

Figure 2:
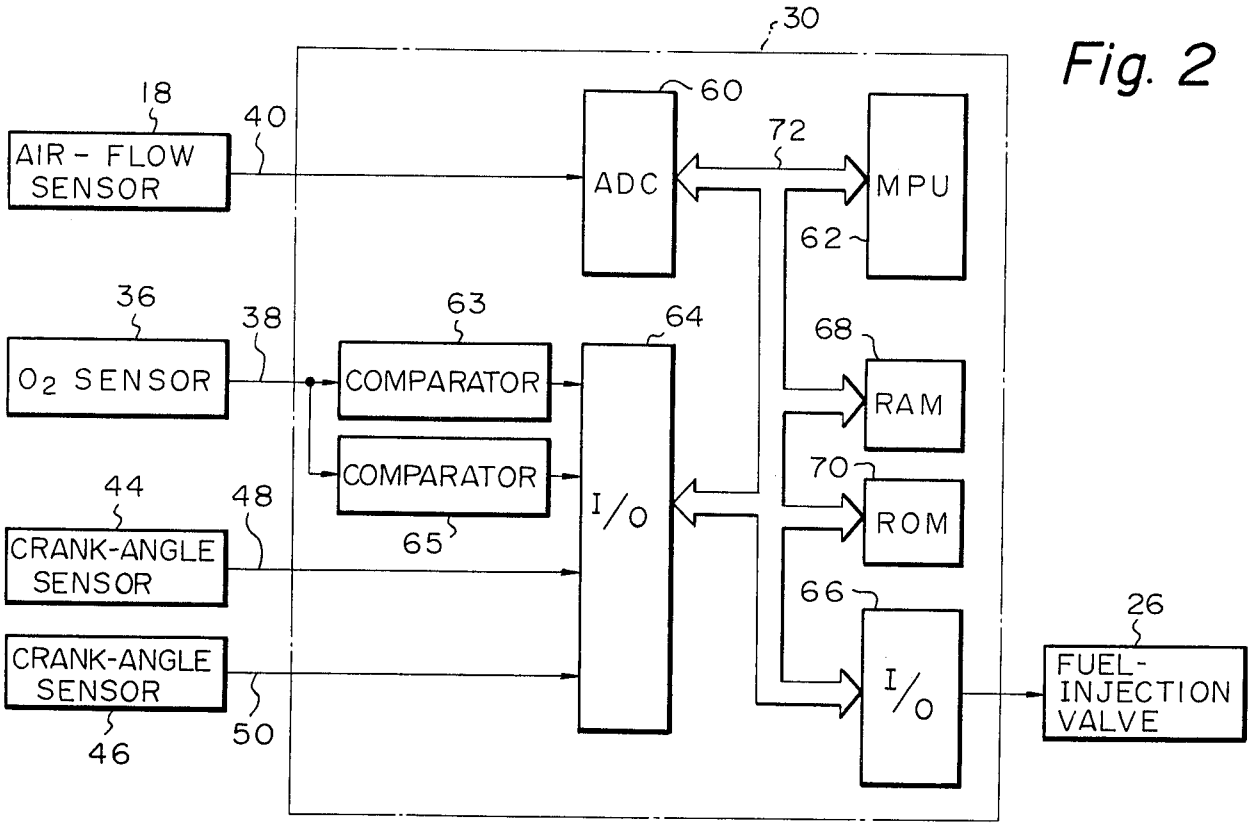
FIG. 2 is a block diagram illustrating the control circuit shown in FIG. 1.

FIG. 2 illustrates an embodiment of the control circuit 30 shown in FIG. 1. In FIG. 2, the air-flow sensor 18, $O_2$ sensor 36, crank-angle sensors 44 and 46, and fuel-injection valve 26 for each cylinder are represented by blocks, respectively.

The signal from the air-flow sensor 18 is fed to an analog-to-digital (A/D) converter 60, which contains an analog multiplexer, and is converted into a signal in the form of binary numbers in response to instructions from a microprocessor (MPU) 62.

The detection signal from the $O_2$ sensor 36 is fed to two comparators 63 and 65 and is compared with respective reference signals which are different from each other. The reference signal voltage in the comparator 63 is about 0.4 V, and the reference signal voltage in the comparator 65 is about 0.5 V, being higher than that in the comparator 63.

The comparator 63 produces an A/F signal $O_{X1}$ of "1" when the $O_2$ sensor's output is higher than or equal to 0.4 V and produces an A/F signal $O_{X1}$ of "0" when the $O_2$ sensor's output is lower than 0.4 V. The comparator 65 produces an A/F signal $O_{X2}$ of "1" when the $O_2$ sensor's output is higher than or equal to 0.5 V and produces an A/F signal $O_{X2}$ of "0" when the $O_2$ sensor's output is lower than 0.5 V. These A/F signals $O_{X1}$ and $O_{X2}$ from the comparators 63 and 65 are fed to an input-output (I/O) circuit 64.

The pulse signals produced by the crank-angle sensor 44 at every crank angle of 30° are fed to the MPU 62 via the I/O circuit 64 as interrupt-request signals from the interruption routine of every 30° crank angle. The pulse signals from the crank-angle sensor 44 are further fed to a timing counter, which is disposed in the I/O circuit 64, as counting pulses. The pulse signals produced by the crank-angle sensor 46 at every crank angle of 720° are used as reset pulses of the above timing counter.

In an I/O circuit 66, a register which receives output data corresponding to a fuel-injection pulse width of $\tau$ from the MPU 62, a binary counter which starts the counting operation with respect to clock pulses when fuel-injection initiation pulses are fed from I/O circuit 64 to the binary counter, a binary comparator for comparing the contents in the above register and binary counter, and a driver are provided. The binary comparator produces an injection pulse signal of "1" level from the time when the fuel injection initiation pulse is supplied thereto until the contents in the binary counter coincide with the contents in the register. Therefore, the injection pulse signal produced by the binary comparator has a pulse width of $\tau$. The injection pulse signal is fed to the fuel-injection valve 26 via the driver. The fuel-injection valve 26 thus injects into the engine a quantity of fuel corresponding to the pulse width of $\tau$ of the injection pulse signal.

The A/D converter 60 and I/O circuits 64 and 66 are connected via a bus 72 to the MPU 62, a random access memory (RAM) 68, and a read only memory (ROM) 70 which constitute the microcomputer. The data are transferred via the bus 72.

In the ROM 70 are stored beforehand routine programs for main processing and interrupt processing and various types of data which is necessary for carrying out arithmetic calculations.

Hereinafter, the operation of the microcomputer will be illustrated with reference to the flow diagrams of FIGS. 3, 4, and 5.

Figure 3:
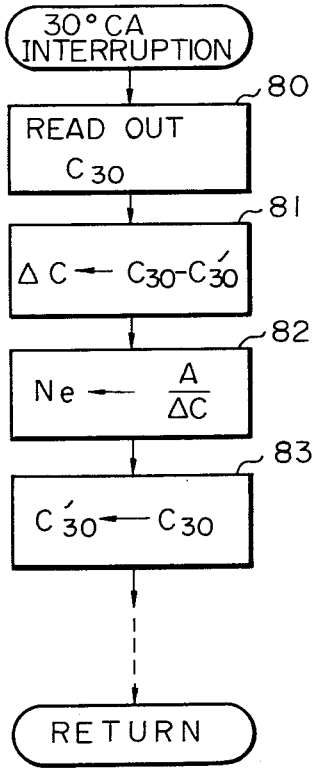
FIGS. 3, 4A, 4B, and 5 are flow diagrams of control programs according to the present invention.

When the MPU 62 receives a pulse signal at every crank angle of 30° from the crank-angle sensor 44, the MPU 62 executes the interrupt-processing routine shown in FIG. 3 for producing rpm data which indicates actual rotational speed Ne of the engine.

At point 80, the contents of the free-run counter provided in the MPU 62 are read out and temporarily stored in the register in the MPU 62 as $C_{30}$. At point 81, the difference $\Delta C$ between contents $C_{30}$ of the free-run counter, which contents are read out in the present interruption cycle, and contents $C'_{30}$ in the free-run counter, which contents were read out in the last interruption cycle, is calculated from the equation $\Delta C = C_{30} - C'_{30}$. Then, at point 82, the reciprocal of the difference $\Delta C$ is calculated to obtain rotational speed Ne. Namely, at point 82, calculation of $Ne = A/\Delta C$ is executed, where A is a constant. Calculated Ne is stored in the RAM 68. At point 83, contents $C_{30}$ in the present interruption cycle are stored in the RAM 68 as contents $C'_{30}$ of the free-run counter in the last interruption cycle and are used in the next interruption cycle. Thereafter, another process is executed in the interrupt-processing routine and then the program returns to the main-processing routine.

The MPU 62 further receives a binary signal which indicates intake-air flow rate Q from the A/D converter 60 in response to the interrupt request which occurs at every completion of A/D conversion. The MPU 62 stores the received binary signals in the RAM 68.

Figure 4A:
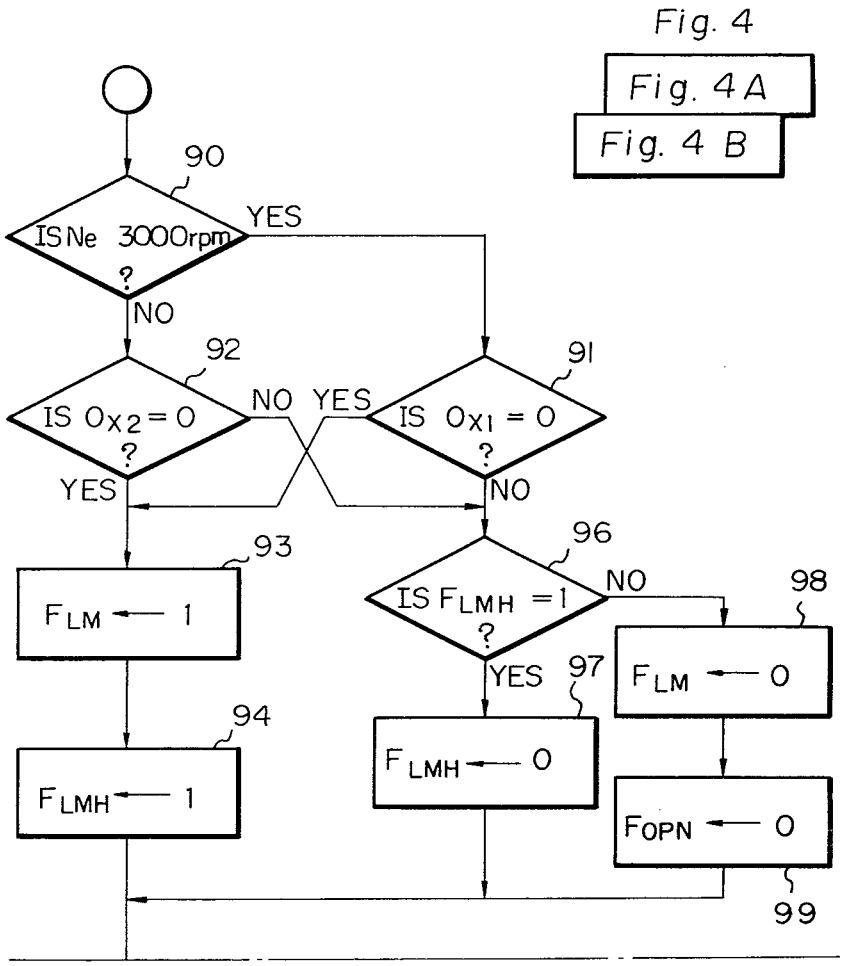
Figure 4B:
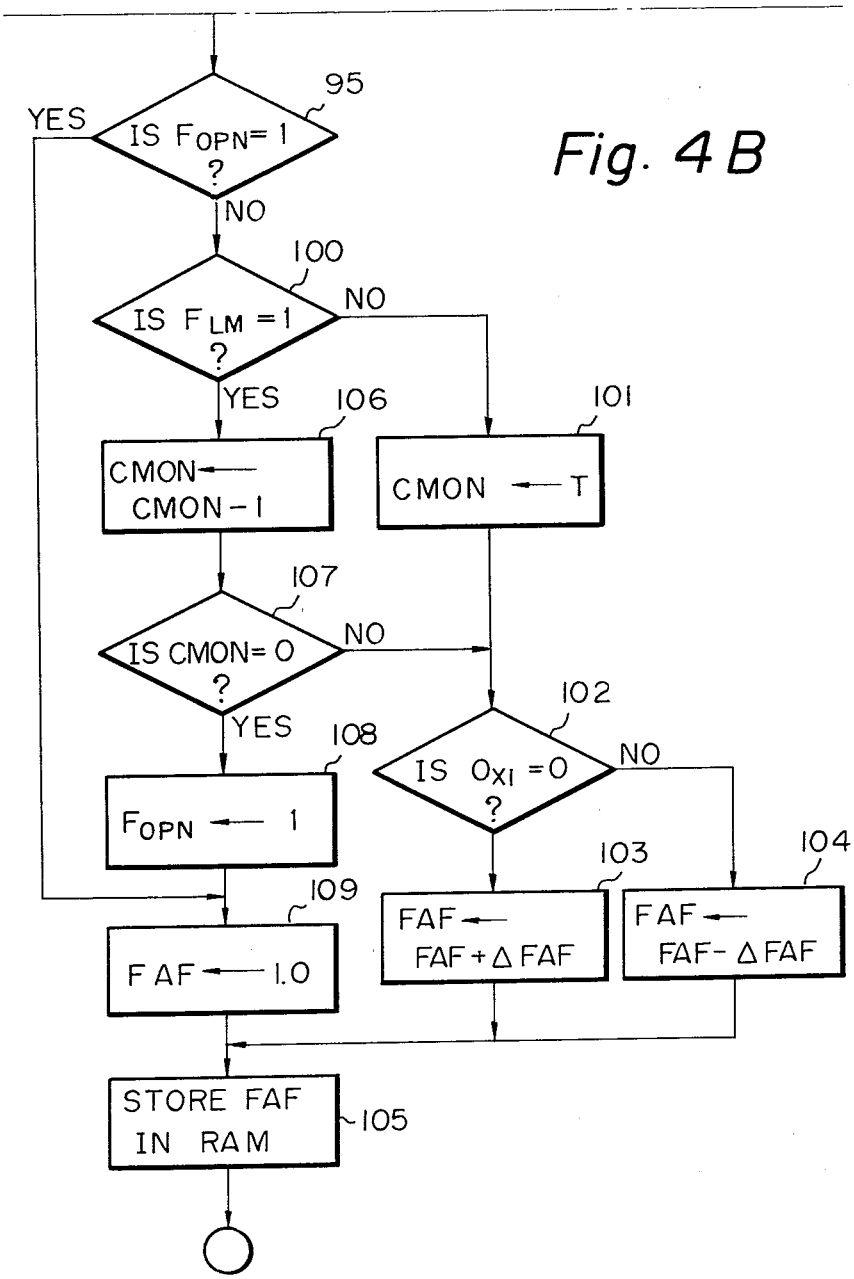

During the main processing routine, the MPU 62 executes the process shown in FIG. 4. The processing routine shown in FIG. 4, however, is executed at intervals of a predetermined period of time, for example, at 50-msec intervals.

At point 90, the MPU 62 reads out the data related to rotational speed Ne from the RAM 68 and discriminates whether or not $Ne \geqq 3000$ rpm. If $Ne \geqq 3000$ rpm, the program proceeds to point 91 where the MPU 62 discriminates whether A/F signal $O_{X1}$ from the comparator 63 is "0" or not. If $Ne < 3000$ rpm, the program proceeds to point 92 where the MPU 62 discriminates whether A/F signal $O_{X2}$ from the comparator 65 is "0" or not. Namely, if $Ne \geqq 3000$ rpm, the reference signal voltage is selected at 0.4 V, and if $Ne < 3000$ rpm, 0.5 V is used.

If it is discriminated that $O_{X1}$="O" or $O_{X2}$="0", namely that the A/F is on the lean side with respect to the stoichiometric condition, the program proceeds to point 93, where a lean monitor flag $F_{LM}$ is set at "1". Then, at point 94, a hysteresis flag $F_{LMH}$ is set at "1". Thereafter, the program proceeds to point 95. Contrary to this, if it is discriminated that $O_{X1}$="1" or $O_{X2}$="1", namely that the A/F is on the rich side with respect to the stoichiometric condition, the program proceeds to point 96. Purposeof the process at points 96 and 97 is to delay air-fuel ratio control for a period corresponding to one operation cycle (50-msec) when the A/F in the engine changes from lean to rich, in order to stabilize the A/F control against noise and chattering. If the program proceeds to point 96 just after the A/F changes from lean to rich, since $F_{LMH}$="1", the program does not proceed to point 98 but proceeds to point 97 where the hysteresis flag $F_{LMH}$ is reset at "0". In the next operation cycle of this routine, the program proceeds from point 96 to point 98.

At point 98, the lean monitor flag $F_{LM}$ is reset at "0", and at point 99, an open-loop control flag $F_{OPN}$ is reset at "0". The open-loop control flag $F_{OPN}$ determines whether control should be carried out by the closed-loop operation ($F_{OPN}$="0") or by the open-loop operation ($F_{OPN}$="1").

At point 95, the MPU 62 discriminates whether the open-loop control flag $F_{OPN}$ is "1" or not. If $F_{OPN} \neq$"1", the program proceeds to point 100 where it is discriminated whether the lean monitor flag $F_{LM}$ is "1" or not. If the A/F is rich, and, accordingly, if $F_{LM}$="0", the program proceeds to point 101 where a monitor counter CMON is initialized to be a value of T which corresponds to a predetermined time, for example, 8-sec. If the operation cycle of the processing routime of FIG. 4 is a 50-msec and the above predetermined time is 4-sec, the initial value of T is given as "160".

At points 102 to 104, an A/F correction factor FAF which is used for calculating the fuel-injection pulse width is calculated. First, at point 102, whether $O_{X1}$="0" or not is discriminated so as to recognize whether the A/F is rich or lean. If it is lean, the program proceeds to point 103 where the A/F correction factor FAF is increased by ΔFAF. If it is rich, the A/F correction factor FAF is decreased by ΔFAF at point 104. As the processing routine of FIG. 4 is repeated at 50-msec, if $F_{OPN}$="0", the A/F correction factor FAF becomes an integral value, with respect to time, of the A/F signal from the comparator 63. Thus-calculated FAF is stored in the RAM 68 at point 105.

On the other hand, if the A/F is lean, and, accordingly, if $F_{LM}$="1", the program proceeds from point 100 to point 106. At point 106, contents CMON in the monitor counter are decreased by "1". At point 107, whether contents CMON become "0" or not is discriminated. In other words, according to the step at points 106 and 107, it is discriminated whether a lean A/F continues for a predetermined time (8-sec) or not. If a lean A/F does not continue for 8-sec, the program proceeds from point 107 to point 102 and thus the A/F correction factor FAF is calculated as usual. However, if a lean A/F continues for more than 8-sec, the program proceeds to point 108 where the open-loop control flag $F_{OPN}$ is set to "1" and then the A/F correction factor FAF is fixed to "1.0" at point 109. If FAF is fixed at "1.0", closed-loop A/F control is stopped and A/F control is executed by the open-loop operation.

If the open-loop control flag $F_{OPN}$ is set at "0" at point 108, the program jumps from point 95 to point 109 thereafter so as to execute open-loop A/F control until the open-loop control flag $F_{OPN}$ is reset at "0" at point 99.

Figure 5:
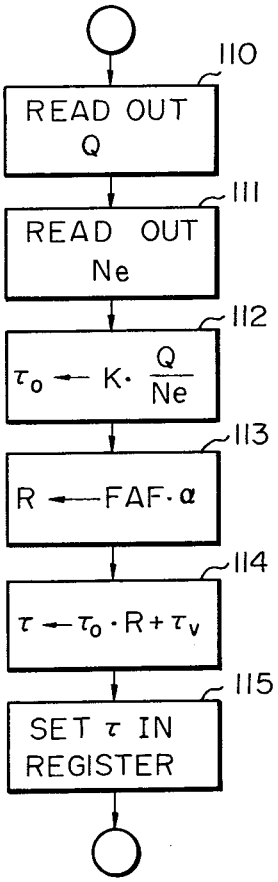

FIG. 5 illustrates a processing routine for calculating the fuel-injection pulse width of $\tau$ by using the thus-calculated A/F correction factor FAF.

During the main processing routine, the MPU 62 executes the process shown in FIG. 5. At points 110 and 111, the MPU 62 reads out the data related to intake-air flow rate Q and rotational speed Ne from the RAM 68, respectively. At point 112, the MPU 62 calculates the basic fuel-injection pulse width of $\tau_O$ of the injection pulse fed to the fuel-injection valve 26 according to the equation $$\tau_O = K \cdot Q/Ne$$

where K is a constant. Then, at point 113, a total enrichment-correction factor R is calculated from the equation $$R = FAF \cdot \alpha$$

where $\alpha$ is an another enrichment factor. At point 114, the MPU 62 calculates a pulse width of $\tau$ from the equation $$\tau = 96_0 \cdot R + \tau_V$$

where $\tau_V$ indicates a dead injection pulse width of the fuel-injection valve 26. The dead injection pulse width corresponds to a time period for compensating a mechanical delay in actuation of the fuel injector. The data which corresponds to the thus-calculated pulse width of $\tau$ is set at point 115 in the aforementioned register in the I/O circuit 66. As a result, fuel is supplied to the engine at a feeding rate corresponding to the calculated pulse width of $\tau$.

Figure 6A:
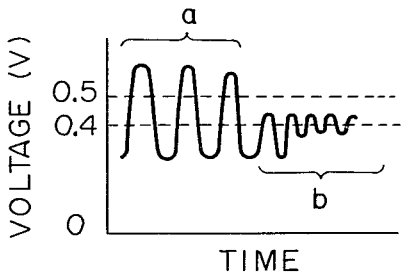
FIGS. 6A and 6B are a wave-form diagram explaining the operation and effect of the present invention.
Figure 6B:
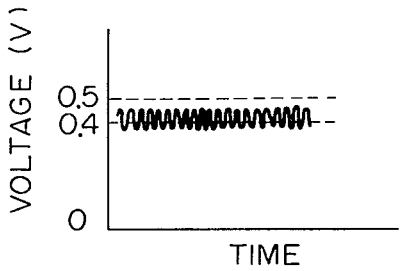

As shown in FIG. 6 (A), the $O_2$ sensor's output is of a large amplitude when the engine speed is low. Therefore, when the engine speed is low, whether or not the $O_2$ sensor is in an active state (range a) or in an inactive state (range b) can definitely be discriminated by using the reference signal 0.5 V. However, when the engine speed is high, since the amplitude of the $O_2$ sensor's output becomes small, as shown in FIG. 6 (B), it cannot be discriminated whether the $O_2$ sensor is malfunctioning or not by using only the 0.5 V reference signal. As is known, the $O_2$ sensor is rarely inactive when the engine speed is high.

According to the above control process, as the reference signal voltage for the lean monitor function is lowered to 0.4 V when engine speed Ne is high (Ne ≧3000 rpm), whether or not breaks occur in the connector or the wiring of the $O_2$ sensor or in the $O_2$ sensor itself can definitely be detected.

As will be apparent from the above-mentioned description, according to the present invention, the reference signal voltage in the lean monitor is selectively changed in accordance with the rotational speed of the engine so that the higher the engine-rotational speed, the smaller the reference signal voltage and vice versa. Therefore, breaks in the $O_2$ sensor or in the wiring of the $O_2$ sensor and whether or not the $O_2$ sensor is in an inactive state can definitely and correctly be detected irrespective of the operating condition of the engine.

As many widely different embodiments of the present invention may be constructed without departing from the spirit and scope of the present invention, it should be understood that the present invention is not limited to the specific embodiments described in this specification, except as defined in the appended claims.

We claim:

1. An air-fuel ratio control method for an internal combustion engine, comprising the steps of:

detecting the concentration of a predetermined component in the exhaust gas to generate a first electrical signal which indicates the detected concentration;

detecting the rotational speed of the engine to generate a second electrical signal which indicates the detected rotational speed;

correcting the feeding rate of fuel supplied to the engine in accordance with said first electrical signal so as to execute a closed-loop air-fuel ratio control operation;

comparing said first electrical signal with a reference signal having a voltage to generate a third electrical signal which indicates that said first electrical signal is lower than the reference signal, the voltage of said reference signal being changed in accordance with said second electrical signal so as to decrease when the rotational speed increases and so as to increase when the rotational speed decreases; and stopping the closed-loop air-fuel ratio control operation to execute an open-loop air-fuel ratio control operation when said third electrical signal is continuously produced for a time longer than a predetermined period of time.

2. A method as claimed in claim 1, wherein said comparing step includes a step of selecting one of two different voltages as the reference signal, in accordance with said second electrical signal.

3. A method as claimed in claim 2, wherein said selecting step includes a step of selecting one of two different voltages as the reference signal, in accordance with said second electrical signal, so as to select the lower of the two voltages when the rotational speed is higher than or equal to a predetermined speed and to select the higher of the two voltages when the rotational speed is lower than the predetermined speed.

4. A method as claimed in claim 1, 2, or 3, wherein said stopping step includes a step of delaying stoppage of the closed-loop air-fuel ratio control operation for a predetermined time.

5. An air-fuel ratio control apparatus for an internal combustion engine, comprising:

means for detecting the concentration of a predetermined component in the exhaust gas to generate a first electrical signal which indicates the detected concentration;

means for detecting the rotational speed of the engine to generate a second electrical signal which indicates the detected rotational speed;

means for correcting the feeding rate of fuel supplied to the engine in accordance with said first electrical signal so as to execute a closed-loop air-fuel ratio control operation;

means for comparing said first electrical signal with a reference signal having a voltage to generate a third electrical signal which indicates that said first electrical signal is lower than the reference signal, the voltage of said reference signal being changed in accordance with said second electrical signal so as to decrease when the rotational speed increases and so as to increase when the rotational speed decreases; and means for stopping the closed-loop air-fuel ratio control operation to execute an open-loop air-fuel ratio control operation when said third electrical signal is continuously produced for a time longer than a predetermined period of time.

6. An apparatus as claimed in claim 5, wherein said comparing means includes means for selecting one of two different voltages as the reference signal, in accordance with said second electrical signal.

7. An apparatus as claimed in claim 6, wherein said selecting means includes means for selecting one of two different voltages as the reference signal, in accordance with said second electrical signal, so as to select the lower of the two voltages when the rotational speed is higher than or equal to a predetermined speed and to select the higher of the two voltages when the rotational speed is lower than the predetermined speed.

8. An apparatus as claimed in claim 5, 6, or 7, wherein said stopping means includes means for delaying stoppage of the closed-loop air-fuel ratio control operation for a predetermined time.

* * * * *